US007438645B2

(12) United States Patent
Hsu

(10) Patent No.: US 7,438,645 B2
(45) Date of Patent: Oct. 21, 2008

(54) GOLF CLUB WITH TILT ADJUSTABLE MECHANISM

(76) Inventor: Hsin I Hsu, 10F-1, No. 58, Sec. 3, Chengde Rd., Taipei City 103 (TW)

( * ) Notice: Subject to any disclaimer, the term of this patent is extended or adjusted under 35 U.S.C. 154(b) by 242 days.

(21) Appl. No.: 11/525,075

(22) Filed: Sep. 22, 2006

(65) Prior Publication Data

US 2008/0076590 A1 Mar. 27, 2008

(51) Int. Cl.
*A63B 69/36* (2006.01)
*A63B 53/02* (2006.01)

(52) U.S. Cl. ..... 473/246; 473/248; 473/306; 473/307

(58) Field of Classification Search ..... 473/305–315, 473/244–248, 296, 562
See application file for complete search history.

(56) References Cited

U.S. PATENT DOCUMENTS

| | | | | | |
|---|---|---|---|---|---|
| 796,802 | A * | 8/1905 | Brown | 473/307 |
| 1,769,235 | A * | 7/1930 | Samaras et al. | 473/245 |
| 1,802,507 | A * | 4/1931 | Hadden | 473/306 |
| 1,882,509 | A * | 10/1932 | Lagerblade | 473/309 |
| 1,983,069 | A * | 12/1934 | Cowdery | 473/310 |
| 2,001,342 | A * | 5/1935 | Dyce | 473/306 |
| 2,027,452 | A * | 1/1936 | Rusing | 473/246 |
| 3,572,709 | A * | 3/1971 | Risher | 473/308 |
| 4,943,059 | A * | 7/1990 | Morell | 473/306 |
| 5,433,442 | A * | 7/1995 | Walker | 473/239 |
| 6,001,027 | A * | 12/1999 | Hansberger | 473/306 |
| 6,475,100 | B1 * | 11/2002 | Helmstetter et al. | 473/309 |
| 6,620,053 | B2 * | 9/2003 | Tseng | 473/297 |
| 6,638,178 | B2 * | 10/2003 | Tseng | 473/306 |
| 6,769,996 | B2 * | 8/2004 | Tseng | 473/306 |
| 6,863,622 | B1 | 3/2005 | Hsu et al. | |
| 7,083,529 | B2 * | 8/2006 | Cackett et al. | 473/309 |
| 7,226,364 | B2 * | 6/2007 | Helmstetter | 473/307 |
| 7,291,073 | B2 * | 11/2007 | Park | 473/245 |
| 7,326,126 | B2 * | 2/2008 | Holt et al. | 473/307 |
| 7,354,353 | B2 * | 4/2008 | Hocknell et al. | 473/288 |
| 2003/0153398 | A1 * | 8/2003 | Tseng | 473/306 |
| 2005/0227779 | A1 * | 10/2005 | Lenhof et al. | 473/305 |

* cited by examiner

*Primary Examiner*—Sebastiano Passaniti
(74) *Attorney, Agent, or Firm*—Rabin & Berdo, P.C.

(57) ABSTRACT

A golf club includes a head, a retaining ring, a tightening ring, an adjusting sleeve, a hosel, a fixing sleeve, a coupler, and a shaft. A pin is threadedly engaged with a transverse screw hole of the neck and a transverse screw hole of the hosel and extended into a transverse hole of the coupler, such that the shaft is pivotable about the pin to allow adjustment in the tilt angle between the shaft and the head. The golf club provides a tilt adjustable mechanism with a strong structure while providing reliable tilt adjustment.

7 Claims, 2 Drawing Sheets

GOLF CLUB WITH TILT ADJUSTABLE MECHANISM

BACKGROUND OF THE INVENTION

1. Field of the Invention

The present invention relates to a golf club and, more particularly, to a golf club with a tilt adjustable mechanism that allows adjustment in a tilt angle between the head and the shaft of the golf club.

2. Description of Related Art

U.S. Pat. No. 6,863,622 discloses a golf club with an adjustable tilt mechanism. The golf club comprises a head, a hosel, a retaining ring, and a shaft. The head includes a neck having a long adjustable hole that is conic and has a wide opening and narrow bottom. The opening rim has a plurality of tie slots distributed at a specific angle. The retaining ring includes a plurality of tie lands along an inner rim thereof. The tie lands of the retaining ring are inserted into the tie slots of the adjustable hole. The retaining ring includes an inner threading for engaging with a threaded section of the shaft. The opening of the hosel receives a section of the shaft exposed under the retaining ring.

When a lower end of the shaft is placed into the long adjusting hole of the neck of the head, a lock pin is extended through a lock hole in the neck and a lock hole in the lower end of the shaft, allowing the shaft to swing to left or to right pivoted on the lock pin within the adjustable hole of the neck to change the tilt (elevation angle) formed between the face of the head and the shaft.

However, at the moment a golf ball is hit by the face of the head, the coupling area between the shaft and the head withstands relatively large lateral stress and reactive vibrations. Since only a small portion of a circumference of the shaft is in contact with the opening rim of the long adjustable hole and since the threaded section of the shaft is formed by etching, the coupling area between the shaft and the neck are liable to break or become loose due to the lateral stress and reactive vibrations.

OBJECTS OF THE INVENTION

An object of the present invention is to provide a golf club with a tilt adjustable mechanism allowing reliable adjustment in a tilt angle between the head and the shaft of the golf club.

Another object of the present invention is to provide a golf club with a tilt adjustable mechanism providing a strong structure to withstand lateral stress and reactive vibrations resulting in hitting of golf balls.

SUMMARY OF THE INVENTION

To achieve the aforementioned objects, the present invention provides a golf club with a tilt adjustable mechanism comprising a head, a retaining ring, a tightening ring, an adjusting sleeve, a hosel, a fixing sleeve, a coupler, and a shaft.

The head includes a neck having an adjusting hole. The adjusting hole includes an end opening defined by a circumferential wall. A plurality of engaging grooves are defined in the circumferential wall defining the end opening. A bottom wall defining the adjusting hole includes a screw hole. A transverse screw hole extends through a lower portion of the neck and in communication with the adjusting hole;

The retaining ring includes a hole and is mounted around the hosel. At least one engaging block is formed on a circumferential wall defining the hole of the retaining ring. The at least one engaging block is engaged in at least one of the engaging grooves of the neck.

The tightening ring is mounted around the hosel. The tightening ring is located between the retaining ring and the adjusting sleeve.

The adjusting sleeve includes a screw hole and the hosel includes an upper end and a lower end. A threaded section is formed on the hosel and adjacent to the upper end of the hosel. The adjusting sleeve is threadedly engaged around the threaded section of the hosel, allowing the adjusting sleeve to move along the threaded section of the hosel. A transverse screw hole is defined in the lower end of the hosel.

The fixing sleeve includes a hole with a first stepped section and a second stepped section. The fixing sleeve is securely mounted around the shaft by the first stepped portion. Further, the fixing sleeve is securely mounted around the upper end of the hosel by the second stepped portion.

The coupler includes two threaded end portions and an intermediate portion between the threaded end portions. A transverse hole is defined in the intermediate portion of the coupler and aligned with the transverse screw hole of the hosel. One of the threaded end portions of the coupler is fixed in a lower end of the shaft, with the other threaded end portion extending beyond a bottom edge of the hosel.

The hosel is fixed to the lower end of the shaft. The lower end of the shaft is mounted in the adjusting hole of the neck of the body, with the other threaded end section of the coupler threadedly and securely engaged with the screw hole in the end wall defining the adjusting hole.

A pin is threadedly engaged with the transverse screw hole of the neck and the transverse screw hole of the hosel and extended into the transverse hole of the coupler, such that the shaft is pivotable about the pin to allow adjustment in the tilt angle between the shaft and the head when the at least one engaging block of the retaining ring is disengaged from the engaging grooves of the neck.

Other objects, advantages and novel features of this invention will become more apparent from the following detailed description when taken in conjunction with the accompanying drawings.

DETAILED DESCRIPTION OF THE PREFERRED EMBODIMENT

Figure 1:
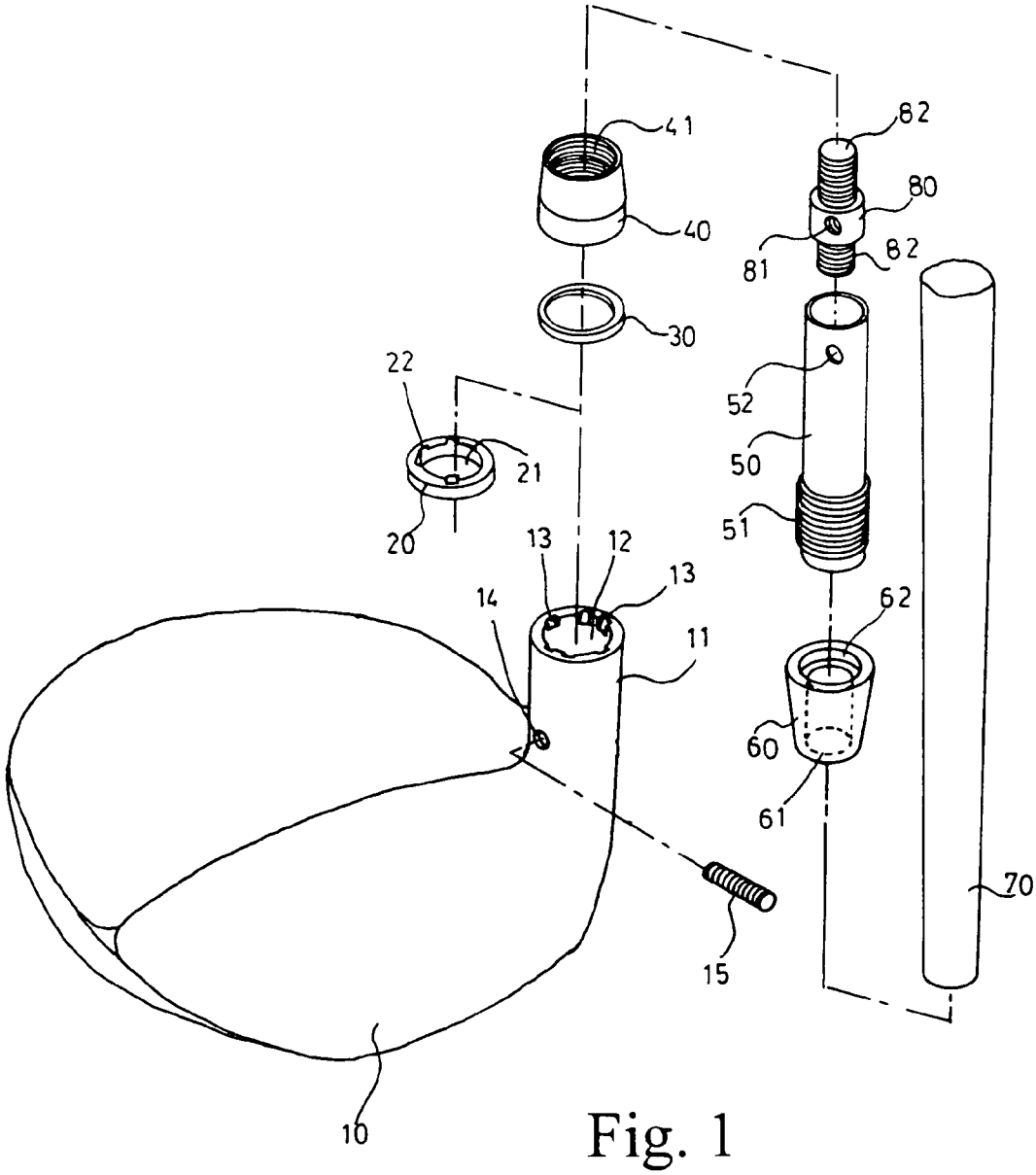
FIG. 1 is an exploded perspective view illustrating a golf club with a tilt adjustable mechanism in accordance with the present invention.

Referring to FIG. 1, a golf club with a tilt adjustable mechanism in accordance with the present invention comprises a head 10, a retaining ring 20, a tightening ring 30, an adjusting sleeve 40, a hosel 50, a fixing sleeve 60, a coupler 80, and a shaft 70.

The head 10 includes a neck 11 having an adjusting hole 12. Preferably, the adjusting hole 12 is conic and tapers downward. The adjusting hole 12 includes an end opening defined by a circumferential wall in which a plurality of annularly spaced engaging grooves 13 are defined. A bottom wall defining the adjusting hole 12 includes a screw hole 16 (see FIG. 2). A transverse screw hole 14 extends through a lower portion of the neck 11 and is in communication with a bottom portion of the adjusting hole 12.

The retaining ring 20 includes a hole 21 having a diameter the same as an outer diameter of the hosel 50. At least one engaging block 22 is formed on a circumferential wall defining the hole 21 of the retaining ring 20. The tightening ring 30 is made of soft, resilient plastic material. The tightening ring 30 is mounted around the hosel 50 and located between the retaining ring 20 and the adjusting sleeve 40.

The adjusting sleeve 40 includes a screw hole 41. The hosel 50 is made of metal and includes a threaded section 51 adjacent to an upper end thereof. The adjusting sleeve 40 is mounted around the threaded section 51 via provision of the screw hole 41, allowing the adjusting sleeve 40 to move along the threaded section 51 upon rotation of the adjusting sleeve 40. A connecting section of the coupler 80 and shaft 70 is wrapped in the hosel 50, and a transverse screw hole 52 is defined in a lower end of the hosel 50.

The fixing sleeve 60 includes a hole with a first stepped section 61 and a second stepped section 62. The fixing sleeve 60 is securely mounted around the shaft 70 by the first stepped portion 61. Further, the fixing sleeve 60 is securely mounted around the upper end of the hosel 50 by the second stepped portion 62. Hence, the coupling area between the hosel 50 and the shaft 70 is reinforced.

The coupler 80 includes two threaded end portions 82 and an intermediate portion between the threaded end portions 82. A transverse hole 81 is defined in the intermediate portion of the coupler 80 and aligned with the transverse screw hole 52 of the hosel 50. One of the threaded end portions 82 of the coupler 80 is fixed in a lower end of the shaft 70, with the other threaded end portion 82 extending beyond the bottom edge of the hosel 50. A gripping portion or member (not shown) is provided on the top end of the shaft 70 to allow comfortable, firm grip, which is conventional.

Figure 3:
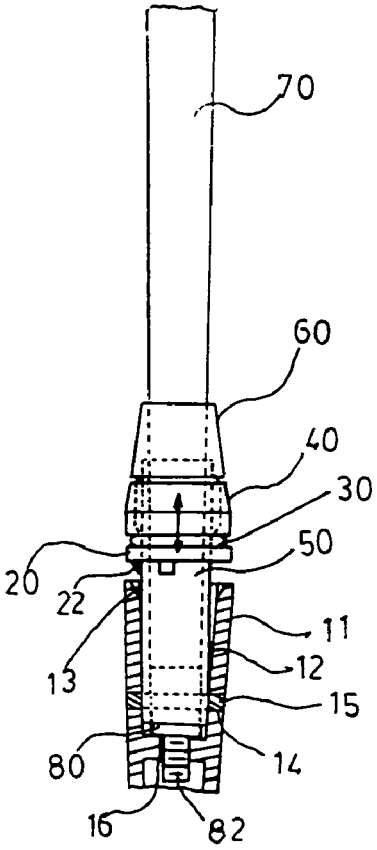
FIG. 3 is a partially sectioned side view of the golf club after assembly.
Figure 2:
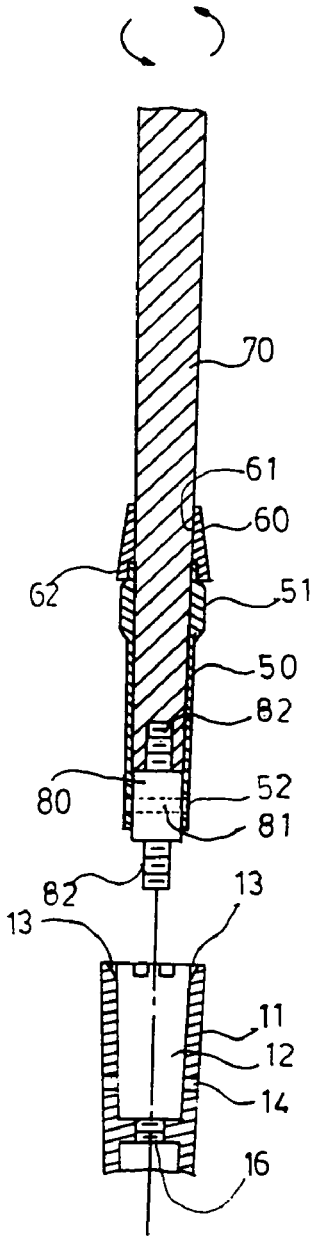
FIG. 2 is a partially exploded sectional view assembling of the golf club in accordance with the present invention.

Referring to FIGS. 2 and 3, in assembly, the adjusting sleeve 40, the tightening ring 30, and the retaining ring 20 are mounted in sequence to the hosel 50 that is mounted around to the lower end of the shaft 70. The lower end of the shaft 70 is inserted into the adjusting hole 12 of the neck 11 of the body 10. The threaded end section 82 of the coupler 80 extending beyond the bottom edge of the hosel 50 is threadedly and securely engaged with the screw hole 16 in the end wall defining the adjusting hole 12. A pin 15 is threadedly engaged with the transverse screw hole 14 of the neck 11 and the transverse screw hole 52 of the hosel 50 and extended into the transverse hole 81 of the coupler 80. Hence, the shaft 70 is pivotable about the pin 15 and adjustable within the adjusting hole 12, allowing adjustment in the tilt angle between the shaft 70 and the head 10.

Figure 4:
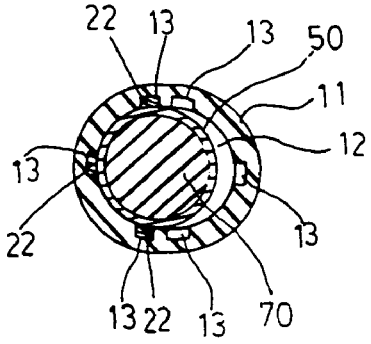
FIG. 4 is a sectional view of the golf club in accordance with the present invention.

Referring to FIGS. 3 and 4, after adjustment in the tilt angle between the shaft 70 and the head 10, the engaging blocks 22 of the retaining ring 20 are engaged in the engaging grooves 13 of the neck 11 (see FIG. 4) to restrain pivotal movement of the shaft 70 in the adjusting hole 12 relative to the pin 15. The adjusting sleeve 40 is moved downward along the threaded section 51 of the hosel 50 and presses against the upper end of the retaining ring 20 through the tightening ring 30. Thus, the engaging blocks 22 cannot be disengaged from the engaging grooves 13 of the neck 11. The shaft 70 is locked accordingly. The engaging blocks 22 may be conic and the engaging grooves 13 may have correspondingly shaped conic structure to allow smooth engagement of the engaging blocks 22 into the engaging grooves 13.

As apparent from the foregoing, since a coupler 80 is coupled to the lower end of the shaft 70 and a metal hosel 50 is mounted around the coupling area between the shaft 70 and the coupler 80 (i.e., the shaft 70 is coupled to the neck 11 by the metal hosel 50), the metal hosel 50 may withstand the lateral stress and reactive vibrations imparted to the head 10 during hitting. The structural strength is not sacrificed while providing the required tilt angle adjusting function. Further, the retaining ring 20 is securely retained in place by the adjusting ring 40 and the tightening ring 30. Namely, inadvertent disengagement of the retaining ring 20 from the neck 11 is avoided, and reliable tilt angle adjustment is provided.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club with a tilt adjustable mechanism comprising a head, a retaining ring, a tightening ring, an adjusting sleeve, a hosel, a fixing sleeve, a coupler, and a shaft, wherein:

the head includes a neck having an adjusting hole, the adjusting hole including an end opening defined by a circumferential wall, a plurality of engaging grooves are defined in the circumferential wall defining the end opening, a bottom wall defining the adjusting hole includes a screw hole, a transverse screw hole extends through a lower portion of the neck and in communication with the adjusting hole;

the retaining ring includes a hole and is mounted around the hosel, at least one engaging block is formed on a circumferential wall defining the hole of the retaining ring, at least one engaging block is engaged in at least one of the engaging grooves of the neck;

the tightening ring is mounted around the hosel, the tightening ring is located between the retaining ring and the adjusting sleeve;

the adjusting sleeve includes a screw hole and the hosel includes an upper end and a lower end, a threaded section is formed on the hosel and adjacent to the upper end of the hosel, the adjusting sleeve is threadedly engaged around the threaded section of the hosel, allowing the adjusting sleeve to move along the threaded section of the hosel, a transverse screw hole is defined in the lower end of the hosel;

the fixing sleeve includes a hole with a first stepped section and a second stepped section, the fixing sleeve is securely mounted around the shaft by the first stepped portion, the fixing sleeve is securely mounted around the upper end of the hosel by the second stepped portion;

the coupler includes two threaded end portions and an intermediate portion between the threaded end portions, a transverse hole is defined in the intermediate portion of the coupler and aligned with the transverse screw hole of the hosel, one of the threaded end portions of the coupler is fixed in a lower end of the shaft, with the other threaded end portion extending beyond a bottom edge of the hosel;

the hosel is fixed to the lower end of the shaft, the lower end of the shaft is mounted in the adjusting hole of the neck of the body, with the other threaded end section of the coupler threadedly and securely engaged with the screw hole in the end wall defining the adjusting hole; and a pin is threadedly engaged with the transverse screw hole of the neck and the transverse screw hole of the hosel and extended into the transverse hole of the coupler, such that the shaft is pivotable about the pin to allow adjustment in the tilt angle between the shaft and the head when said at least one engaging block of the retaining ring is disengaged from said engaging grooves of the neck.

2. The golf club with a tilt adjustable mechanism as claimed in claim 1 wherein the hosel is mounted around the lower end of the shaft and in contact with a circumferential wall defining the adjusting hole of the neck.

3. The golf club with a tilt adjustable mechanism as claimed in claim 1 wherein the hole of the retaining ring has a diameter the same as an outer diameter of the hosel.

4. The golf club with a tilt adjustable mechanism as claimed in claim 1 wherein the tightening ring is made of soft, resilient plastic material and the hosel is made of metal.

5. The golf club with a tilt adjustable mechanism as claimed in claim 1 wherein the adjusting sleeve presses against an upper end of the retaining ring via the tightening ring.

6. The golf club with a tilt adjustable mechanism as claimed in claim 1 wherein said at least one engaging block of the retaining ring is conic and each said engaging groove has a correspondingly shaped conic structure.

7. The golf club with a tilt adjustable mechanism as claimed in claim 1 wherein the adjusting hole is conic and tapers downward.

* * * * *